US008261509B2

(12) United States Patent
Harkin

(10) Patent No.: US 8,261,509 B2
(45) Date of Patent: Sep. 11, 2012

(54) ADJUSTABLE STRUCTURAL HEADER BEAM

(76) Inventor: Paul Harkin, Whitestone, NY (US)

( * ) Notice: Subject to any disclaimer, the term of this patent is extended or adjusted under 35 U.S.C. 154(b) by 98 days.

(21) Appl. No.: 12/660,657

(22) Filed: Mar. 2, 2010

(65) Prior Publication Data

US 2010/0229492 A1 Sep. 16, 2010

Related U.S. Application Data

(60) Provisional application No. 61/209,986, filed on Mar. 13, 2009.

(51) Int. Cl.
*E04H 12/18* (2006.01)

(52) U.S. Cl. ..... 52/645; 52/127.2; 52/848; 248/354.1

(58) Field of Classification Search ..... 52/632, 52/645, 831, 836, 846, 848, 127.2, 167.3, 52/217, 345; 248/342, 343, 200.1, 354.1; 403/80, 104, 112
See application file for complete search history.

(56) References Cited

U.S. PATENT DOCUMENTS

| | | | | | |
|---|---|---|---|---|---|
| 1,267,618 | A * | 5/1918 | Anderson | 182/223 |
| 2,930,564 | A * | 3/1960 | Maier | 248/200.1 |
| 2,962,252 | A * | 11/1960 | Frank | 248/231.81 |
| 2,974,762 | A * | 3/1961 | Hunnebeck | 52/632 |
| 2,999,278 | A * | 9/1961 | Spencer et al. | 52/479 |
| 3,222,095 | A * | 12/1965 | Gerus | 403/104 |
| 3,325,957 | A * | 6/1967 | Demeules et al. | 52/632 |
| 4,348,002 | A * | 9/1982 | Eyden | 249/19 |
| 4,391,428 | A * | 7/1983 | Grimes | 248/546 |
| 4,494,296 | A * | 1/1985 | Grimes | 29/432 |
| 4,574,549 | A * | 3/1986 | Holcombe | 52/404.3 |
| 4,706,359 | A * | 11/1987 | Greenhill et al. | 29/271 |
| 4,768,620 | A * | 9/1988 | South | 182/223 |
| 5,067,589 | A * | 11/1991 | Bartnicki | 182/223 |
| 5,104,269 | A * | 4/1992 | Hardison | 410/149 |
| 5,303,894 | A * | 4/1994 | Deschamps et al. | 248/343 |
| 5,459,967 | A * | 10/1995 | Bodtker | 52/93.1 |
| 5,593,115 | A * | 1/1997 | Lewis | 248/68.1 |
| 5,653,077 | A * | 8/1997 | Carnicello et al. | 52/646 |
| 5,690,423 | A * | 11/1997 | Hentz et al. | 362/365 |
| 5,761,872 | A * | 6/1998 | Sanford et al. | 52/694 |
| 5,803,653 | A * | 9/1998 | Zuffetti | 403/363 |
| 5,845,886 | A * | 12/1998 | McCormick | 248/200.1 |
| 5,927,038 | A * | 7/1999 | Goldberg et al. | 52/632 |
| 6,033,098 | A * | 3/2000 | Hentz et al. | 362/430 |
| 6,233,877 | B1 * | 5/2001 | Monroe | 52/37 |
| 6,237,884 | B1 * | 5/2001 | Howe | 248/200.1 |
| 6,666,419 | B1 * | 12/2003 | Vrame | 248/200.1 |
| 6,928,782 | B2 * | 8/2005 | Becker et al. | 52/696 |
| 7,546,718 | B2 * | 6/2009 | Vasta | 52/632 |
| 7,621,493 | B2 * | 11/2009 | Vermette et al. | 248/200.1 |
| 7,716,882 | B2 * | 5/2010 | Smelser | 52/167.9 |
| 2002/0074915 | A1 * | 6/2002 | Shih | 312/334.5 |
| 2002/0116891 | A1 * | 8/2002 | Waldrop | 52/632 |
| 2003/0205019 | A1 * | 11/2003 | Becker et al. | 52/645 |
| 2006/0237601 | A1 * | 10/2006 | Rinderer | 248/200.1 |
| 2007/0089374 | A1 * | 4/2007 | Vasta | 52/204.2 |
| 2008/0250747 | A1 * | 10/2008 | Johnson et al. | 52/693 |

* cited by examiner

*Primary Examiner* — William Gilbert
*Assistant Examiner* — James Ference
(74) *Attorney, Agent, or Firm* — Gerald T. Bodner

(57) ABSTRACT

A longitudinal length adjustable header made up of a center section and two end sections moveably attached to the center section. The center section has an "L" shaped cross section and at least two longitudinal slots that are adapted to receive bolt means there through. The end sections have a plurality of apertures that align with the slots in the center section and are adapted to receive bolt means there through. The end sections are longitudinally slidable with respect to the center section whereby enabling adjusting the length of the header.

4 Claims, 2 Drawing Sheets

ADJUSTABLE STRUCTURAL HEADER BEAM

HISTORY OF THE INVENTION

Figure 1:
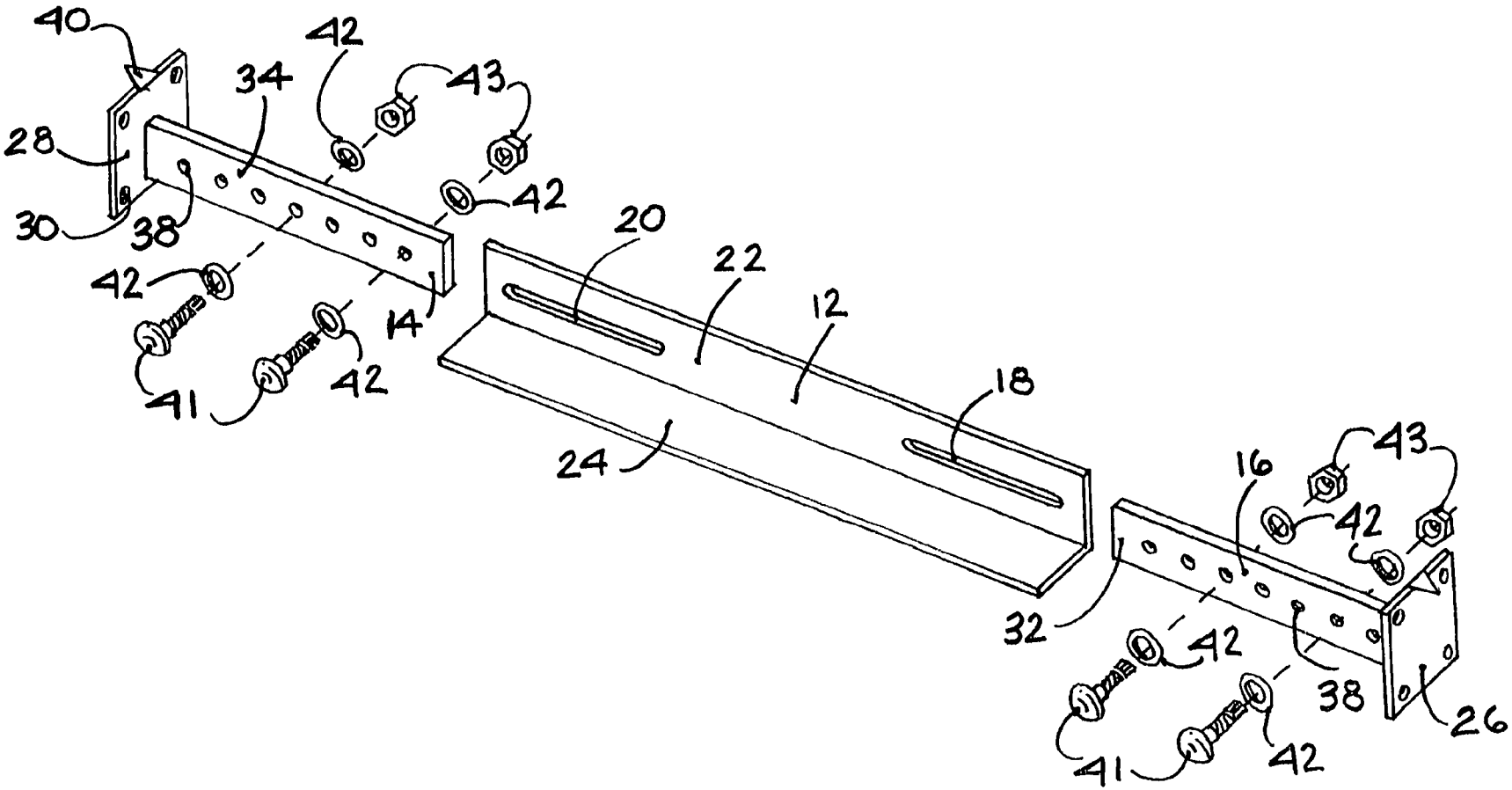

This application is a continuation in part of provisional patent application Ser. No. 61/209,986 filed Mar. 13, 2009. The contents of said provisional patent application are incorporated herein by reference.

BACKGROUND OF THE INVENTION

This invention is directed to a multi-element, adjustable structural header beam that is adapted to be used in existing construction, such as in the building of a residential house, office building or in other similar building structure. It is also particularly usable where it is desired to reinforce existing floor or ceiling joists and/or to replace existing header beam(s) in order to remove one or more existing decayed or broken header or section of a header. It is further useful for inserting functional elements, such as a drain or water pipe, or a toilet and associated drain pipe configurations in a floor defined by the header. The header of this invention is conveniently made of conventional structural building materials, such as steel.

GENERAL DESCRIPTION OF THE INVENTION

The header of this invention is made up of several main sections, in particular at least one center section assembly that comprises one or more interleaved element(s) that are bolted together using a plurality of conventional nuts and bolts together with ordinarily associated washer elements such that the center assembly acts as a single structural element that provides structural integrity in the manner to be described below. The assembly further comprises at least two end elements that may be symmetrically or asymmetrically attached to the center section using multiple nut, bolt and washer combinations. The end elements comprise suitably sized holes that are adapted to receive the shanks, of several bolts, respectively.

The center sections each comprise a longitudinal slot that is sized and located so as to overlap with the holes in the end sections. The shanks of the bolts that are adapted to pass through the holes in the end sections are also adapted to pass through the slots, respectively, in the center section. It is considered to be within the scope of the instant invention to replace the aforementioned slot(s) with a series of holes. Suitably, the diameters of the slots, or center section holes, are at least as wide as the holes in the end sections so that the shank portions of the above referenced bolts neatly fit through both of these sets of holes/slots with a minimum of clearance so as to enable the formation of a tight fit that has some longitudinal leeway. Thus, the length of the instant header is easily adjustable by longitudinally sliding one or both end sections relative to the center section, and relative to each other, whereby causing several end section holes to closely overlap with portions of the center section slots or holes.

Clearly, the vertical portion of the center section is the largest vertical load bearing portion of the instant header. However, the center section has at least two longitudinal slots (or a plurality of holes) that detract from the over all vertical load carrying capacity of the center section. Therefore it is desirable that multiple bolts should be used and it is further desirable that the shanks of the bolts should have a snug fit in relation to the center section holes/slots.

The center section (s) has a generally "L" shaped cross section. That is, this center section is made up of a first longitudinal leg that is adapted to be disposed in a generally vertical disposition and a second longitudinal leg that is adapted to be disposed in a generally horizontal disposition. While it is preferred that the (first) center section has a longer vertical component and a shorter horizontal component this is not an absolute requirement. It is considered to be within the scope of this invention that the legs of the center section can be the same length. Alternatively the horizontal portion of the (first) center section can be longer than the vertical portion of the center section. The relative widths of the horizontal and vertical center elements are a design feature that is determined by the intended use of the header.

The first of the two center sections is conveniently formed from a single piece of steel plate by bending it longitudinally along an appropriate axis so that the horizontal section and the vertical section are normal to each other. Alternatively, the two legs that make up the first section may be individually formed and then joined together, such as by welding, along an appropriate juncture line. The center section of the instant header may be made up of one or a multiple of elements. For example, two legs of a first center section can be assembled together so that the assembled section constitutes a substantially right angle either by bending a plate or by joining (e.g. welding) together two appropriately sized and shaped plates. The angle of joining of these two plates need not be exactly 90°, however, it is preferred that the angle of attachment of these two plates at least approach a right angle.

Where the center section is made up of more than one member, a second center section can be composed of two longitudinally joined channel members. These channel members are longitudinally joined together at the same angle as results in the "L" shaped cross section of the first center section so that the first and second center channels fit together when the first center section is longitudinally inserted into the channel members of the second center section. The second center section is similar to the first center section but, in addition to the elements of the first center section, the second center section has longitudinal channel members that terminate each longitudinal end portion of the legs. As with the first center section, the second center section is made up of a horizontal leg and a vertical leg. The vertical leg of the second center section that is terminated by a channel structure is not necessarily wider than the horizontal leg of the second center section that is also terminated by a channel structure. However, just as the relative widths of the vertical and horizontal portions of the first center section can be made the same or different, so too the relative widths of the vertical and horizontal portions of the second center section can be the same or different. Since one of the center sections is terminated by channel means and the other of the center sections is intended to be inserted into these channel means, it should be clear that the vertical portion of the first center section should be slightly narrower than the vertical portion of the second center section to allow the vertical portion of the first center section to be inserted into its corresponding channel. Similarly, the width of the horizontal portion of the first center section should be slightly narrower than the width of the horizontal portion of the second center section so as to enable the horizontal portion of the second center section to slide into the corresponding channel.

In one embodiment of this invention, vertical plates are attached to the distal ends of the first and second end sections, respectively. These plates are disposed normal to the end sections and are adapted to fit against and be attached to next adjacent existing header beams. The end plates are firmly attached to the end sections, suitably by welding or the like. The end plates are suitably provided with apertures, preferably a plurality of apertures, whereby enabling them to receive screws and/or bolts and appropriate washers where necessary that are adapted to attach the instant expandable header beam to at least one structurally suitable next adjacent header beam. If the next adjacent previously installed header beams are made of wood, the holes in the end plates should be adapted to receive screws. If the next adjacent previously installed header beams are wood, the holes in the end plates can be adapted to receive either screws or bolts. If the next adjacent header beams are made of metal, the holes in the end plates should be adapted to receive bolts that will pass through the end plate and its adjacent previously positioned header beam.

In a preferred aspect of this invention, the end section is configured from two parallel elements transversely spaced apart a sufficient distance that the vertical element of the center section fits between the two parallel end elements. Holes are provided in both of the parallel elements to coincide with the slot in the center section so the shank of a suitable number of bolts will pass successively through a first element of the end section, then through the slot in the center section, and thence through the other element of the end section. This assembly is then adapted to have a washer and a nut disposed over the shank of the bolt and tightened sufficiently to stabilize it.

As noted above in one aspect of this invention the center section has an "L" cross section with corresponding slots or apertures assembling the center section to the longitudinally "slidaable" slidable end sections. In one aspect of this invention, where there are two center members, the longitudinal edges of the one of the center section members are folded over sufficient to receive the longitudinal edge portions that are . "folded over" to form channels. The effective length of the instant header is a function of the length that the end and center sections overlap plus the length that either one or both of the center sections extends beyond the overlapped distance. Preferably, the beam of the instant invention is assembled by inserting the end of a first center member into the channels of the second center member and sliding the first center member into the channels of the second center member for a suitable distance that is consistent with the requirements of cantilever support. It is within the scope of the instant invention to either attach the assembled first and second center members together by providing holes of suitable diameter in corresponding locations in the first and second center members and by passing bolts through these holes to be then fastened by washers and nuts. Alternatively the two center members can remain unbolted if the end plates of the two center sections are suitably tightly attached to the next adjacent header members.

Because the distal ends of the first and second sections are fastened to the next adjacent header beams that are themselves fixed in position, the total length of the instant header can be fixed without the first and second center sections being attached to each other. While it is acceptable to fasten the first and second center members together, that is not a requirement of the instant invention. The overlapping center members may be simply inserted as aforesaid without further binding these elements to each other provided that the inserted first horizontal and vertical elements form a relatively tight fit with the channel means.

For ease of understanding the first center section of the header of this invention is being described in relation to hypothetical horizontal and vertical positions. However, the spatial positioning of the instant header is not limited to the described horizontal and vertical positions. That is, the header can be positioned relative to the horizontal and vertical as described but it can also be positioned differently. Spatial relationships of the header and of its various elements relative to horizontal and vertical planes are arbitrary. and for convenience only.

It should be noted that in an aspect of this invention where the header is made up of two center elements and two side elements attached, respectively, to the center elements, instead of the center elements having vertical plates affixed thereto, these vertical plates will be attached to the side sections in the same manner as set forth above.

The side sections of the header of this invention are made up of a first vertical plate, sometimes referred to as a distal vertical flange, that is adapted to be disposed at a right angle with respect to the distal end of the inner section or, where it is present, the distal end of an extension side section. In a preferred embodiment of this invention, each side section has second and third generally parallel plates that are slightly spaced apart from each other and extend perpendicular to the first vertical plate. The positioning of these second and third plates is such that the vertical portion of each of the center sections is adapted to fit between them. The second and third plates have horizontal dimension that are sufficient to cover the aforementioned slots in the long leg of the first and/or center section. The second and third plates have a plurality of holes disposed in them in such position that when the header is assembled a plurality of these holes match up with the aforementioned slots and are adapted to receive bolts there through.

The second and third vertical plates are spaced apart a distance of approximately the thickness of the long leg of the first and second center sections, respectively, and are adapted to receive the vertical leg of a center section there between. These second and third vertical plates are each preferably distally attached to the vertical flange that is disposed at a right angle with respect to them. Therefore, upon assembly, this distal vertical flange is also at substantial right angles with respect to both horizontal legs of the center sections.

Either the end sections can be composed of two parallel elements element with the center section disposed between them or the end section can be composed of one element disposed between two parallel center section sub-elements. In either case, the joint between the end section and the center section is composed of at least three elements; two end sub-elements surrounding one center section; or two center sub-elements surrounding one end section. It will be appreciated that there may be more than three parallel elements making up this joint. It will also be appreciated that the header of this invention may be made up of more than three sections. That is, there may be side elements inserted between the aforedescribed center section and at least one of the two end sections. When there are such additional side sections the joints connecting the end sections to the center section can include at least one side section attached, respectively, to both the end and the center sections.

Figure 2:
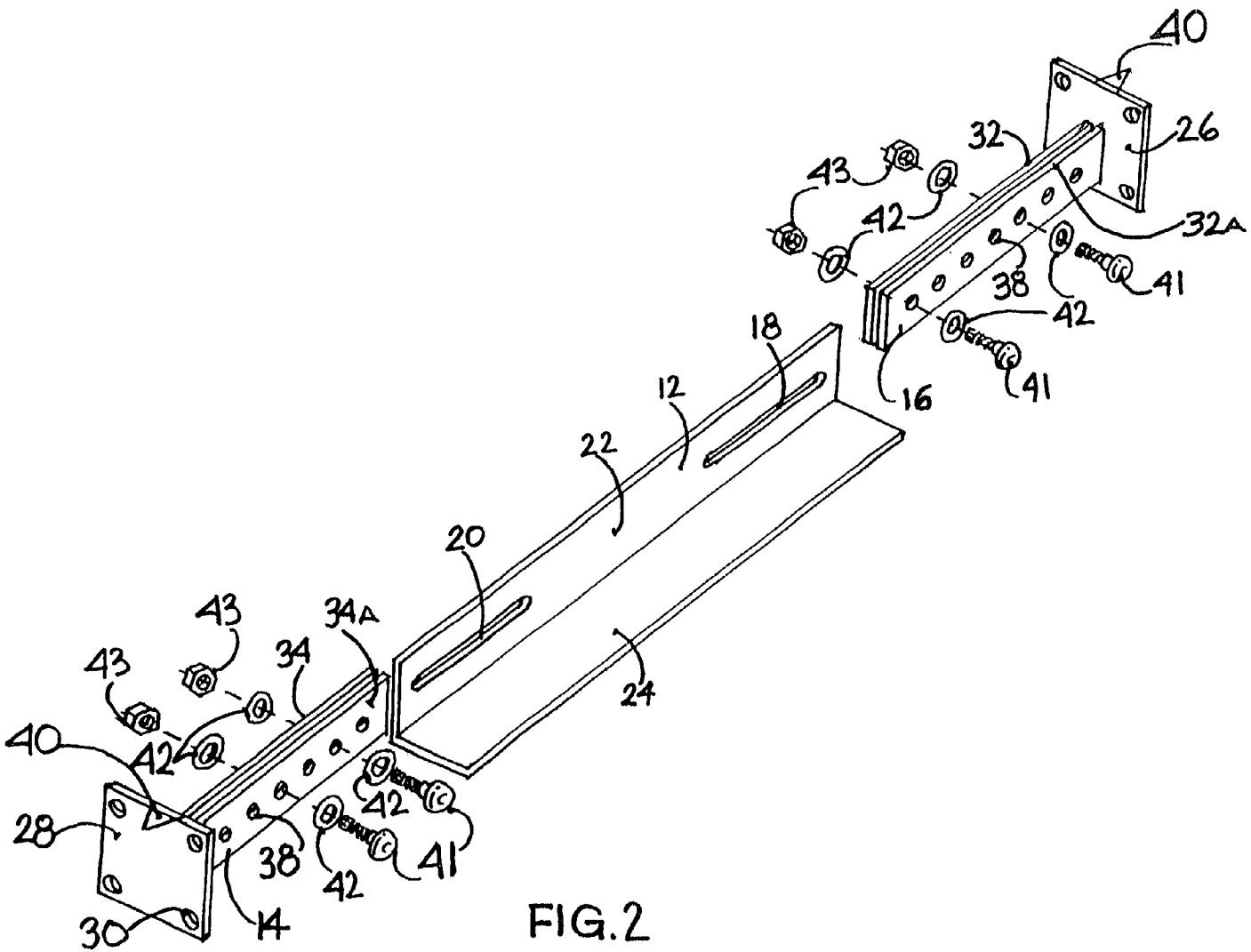

The drawing being filed as part of the instant patent application shows the end sections and the center sections in various relative positions:

FIG. 1 is a front perspective view showing three major parts of the header of this invention disassembled and exploded from side to side, and FIG. 2 is similar to FIG. 1, that is it is a perspective view showing the three major parts of the header of this invention and showing bifurcated end sections;

DETAILED DESCRIPTION OF THE INVENTION

The bolts 41 that pass through the holes in the end sections as well as in the center section slot and the washers 42 and nuts 43 are shown in FIGS. 1 and 2. However, the holes and slot through which they pass are well shown and described. Note should be taken of the pointed element 40 that is intended to be inserted into a next adjacent wood header of this invention.

The aperture elements in the end sections and the slots in the center section are designed to have small enough lateral spacing to enable the side sections and the center section to move longitudinally with respect to each other during assembly whereby greatly decreasing the difficulties of field assembly. It is desirable that the width of the slots in the center section and the diameter of the holes in the side section both snugly fit around the shanks of a suitable number of bolts 41 so that there is a minimum of play between the end and center sections and between the bolts and both the center and end sections. However, in order to assist in field assembly, the width of the slot should be slightly larger than the diameter of the bolt that is passing through it.

Note that the end sections can be joined to the center section in a symmetrical or unsymmetrical configuration. Note too that where the header employs multiple center sections each center section can be symmetrically disposed or they may be asymmetrically disposed relative to the other center section. That is, each end section can be attached to its respective center section portion in such a manner that it extends the same distance from the horizontal center the center section or, in the alternative, each or either end sections can extend a different distance from the horizontal center of the center section.

The vertical distal flanges joined to the end sections can be attached to adjacent pre-existing beams by conventional attachment means, such as screws or bolts, or fixed against these pre-existing beams by means of outward pressure exerted on them. It is within the scope of this invention to employ multiple attachment means. In order to facilitate attaching the instant header to preexisting adjacent headers, strike pins 40 can be attached normal to the side of the distal vertical flange that is opposite to the side of the distal vertical flange that is adjacent the center section.

Suitable bolts are adapted to pass, respectively, first through the above mentioned hole in one of the vertical plates (such as the second end section plate) that makes up part of a end sections, then through a portion of a slot in the center section and then through the other vertical plate (such as the third side section plate) of the same side section. It is preferable to attach each end section to the center section by a plurality of bolts 41 disposed through the slots. The plurality of bolts 41 assembling this header can be placed adjacent to each other or they may be spaced apart. The diameter of the bolts 41 is substantially the same (actually slightly smaller for ease of assembly) than the width of the slot through and the holes that it is intended to pass. It is contemplated that suitable washers 42 will be used in combination with any or all of the bolts 41/nuts 43.

Referring now to the drawing figures, one aspect of this invention is described as follows:

The header is made up of two major elements 12 and 14 (two end sections). Element 12 is the center section and elements 14 and 16 are the end sections of this header. Note that the center section has two horizontally aligned slots 18 and 20. The center section is made up of a vertical element 22 and a horizontal element 24. In the depicted example the side sections 14 and 16 are mirror images of each other. Each side section comprises a distal vertical flange 26 and 28, respectively. These flanges have at least one (in the drawing four are shown in each flange) aperture 30 that is adapted to be used to join the instant header to a next adjacent pre-existing header (not shown) that is not part of the header of this invention. Each of these holes is adapted to receive a fastener (not shown), such as a screw, that will attach the instant end section to the pre-existing header. The end sections 14 and 16 have vertical second and third plates 32 and 34 that extend from the flanges 28 and 26 respectively. As so arranged, the holes 38 are aligned with the slots 20 and 18, and the combination is adapted to receive a plurality of bolts 41, nuts 43 and washers 42 shown in FIGS. 1, and 2. Pointed protrusions 40 extend from the vertical flanges in a position for engagement with pre-existing header beams. These protrusions 40 may be pointed so as to become inserted in the next adjacent wooden header. Further, they may not be pointed but may sit on top of the instant header to align it with a pre-existing header beam.

As shown in FIG. 2, a modified aspect of this invention comprises providing the vertical plates 32 and 34 as actually comprising two plates. It will be noticed that each pair of these vertical plates is spaced apart a distance sufficient to permit engagement of a part of the vertical portion of the center section between them. The vertical portion of the center section must enable insertion into this space a distance sufficient to enable at least two of the holes in the side elements 38, respectively, to overlap its respective slot 18 and/or 20.

What is claimed is:

1. A load bearing, structural header which is adjustable in length, which comprises:

a center section, the center section being generally "L" shaped in transverse cross section and including a first elongated leg and a second elongated leg joined perpendicularly to the first elongated leg, each of the first leg and the second leg having a thickness, the center section further having a first slot formed through the thickness of the first leg, and a second slot formed through the thickness of the first leg;

a first end section, the first end section including at least one elongated plate having a thickness, the at least one plate of the first section having a plurality of spaced apart apertures formed through the thickness thereof, the first end section being adjustably mounted on the center section in proximity to the first slot formed in the center section;

a second end section, the second end section including at least one elongated plate having a thickness, the at least one plate of the second section having a plurality of spaced apart apertures formed through the thickness thereof, the second end section being adjustably mounted on the center section in proximity to the second slot formed in the center section;

a first plurality of bolts, the first plurality of bolts being received by corresponding spaced apart apertures of the plurality of apertures formed through the thickness of the at least one plate of the first end section and further being received by the first slot of the center section;

a second plurality of bolts, the second plurality of bolts being received by corresponding spaced apart apertures of the plurality of apertures formed through the thickness of the at least one plate of the second end section and further being received by the second slot of the center section;

a first flange, the first flange being joined perpendicularly to the first end section; and a second flange, the second flange being joined perpendicularly to the second end section.

2. The load bearing, structural header as defined by claim 1, which further comprises:

at least a first pointed protrusion joined to and extending outwardly from the first flange; and at least a second pointed protrusion joined to and extending outwardly from the second flange.

3. A load bearing, structural header which is adjustable in length, which comprises:

a center section, the center section being generally "L" shaped in transverse cross section and including a first elongated leg and a second elongated leg joined perpendicularly to the first elongated leg, each of the first leg and the second leg having a thickness, the center section further having a first slot formed through the thickness of the first leg, and a second slot formed through the thickness of the first leg;

a first end section, the first end section including a first elongated plate and a second elongated plate, the second elongated plate of the first end section being spaced apart laterally from the first elongated plate of the first end section and extending in parallel with the first elongated plate of the first end section to define a space between the first elongated plate and the second elongated plate of the first end section, each of the first elongated plate and the second elongated plate of the first end section having a thickness, each of the first elongated plate and the second elongated plate of the first end section having a plurality of spaced apart apertures formed through the thickness thereof, the first end section being adjustably mounted on the center section in proximity to the first slot formed in the center section, the first elongated leg of the center section being received within the space defined between and by the first elongated plate and the second elongated plate of the first end section;

a second end section, the second end section including a first elongated plate and a second elongated plate, the second elongated plate of the second end section being spaced apart laterally from the first elongated plate of the second end section and extending in parallel with the first elongated plate of the second end section to define a space between the first elongated plate and the second elongated plate of the second end section, each of the first elongated plate and the second elongated plate of the second end section having a thickness, each of the first elongated plate and the second elongated plate of the second end section having a plurality of spaced apart apertures formed through the thickness thereof, the second end section being adjustably mounted on the center section in proximity to the second slot formed in the center section, the first elongated leg of the center section being received within the space defined between and by the first elongated plate and the second elongated plate of the second end section;

a first plurality of bolts, the first plurality of bolts being received by corresponding spaced apart apertures of the plurality of apertures formed through the thicknesses of the first elongated plate and the second elongated plate of the first end section and further being received by the first slot of the center section, whereby the first plurality of bolts pass through the thickness of the first elongated plate of the first end section, the thickness of the first leg of the center section and the thickness of the second elongated plate of the first end section;

a second plurality of bolts, the second plurality of bolts being received by corresponding spaced apart apertures of the plurality of apertures formed through the thicknesses of the first elongated plate and the second elongated plate of the second end section and further being received by the second slot of the center section, whereby the second plurality of bolts pass through the thickness of the first elongated plate of the second end section, the thickness of the first leg of the center section and the thickness of the second elongated plate of the second end section;

a first flange, the first flange being joined perpendicularly to the first end section; and a second flange, the second flange being joined perpendicularly to the second end section.

4. The load bearing, structural header as defined by claim 3, which further comprises:

at least a first pointed protrusion joined to and extending outwardly from the first flange; and at least a second pointed protrusion joined to and extending outwardly from the second flange.

* * * * *